US005129754A

United States Patent [19]

Brower

[11] Patent Number: 5,129,754

[45] Date of Patent: Jul. 14, 1992

[54] EXPANSION JOINT SEALS

[75] Inventor: James R. Brower, Latham, N.Y.

[73] Assignee: JMK International Inc., Fort Worth, Tex.

[21] Appl. No.: 160,733

[22] Filed: Feb. 26, 1988

[51] Int. Cl.[5] ..... E01C 11/10; E01C 23/02

[52] U.S. Cl. ..... 404/65; 404/87

[58] Field of Search ..... 404/47, 49, 64–69, 404/74, 87, 88; 14/16.1; 52/396, 403, 573; 49/498; 277/12, 205, 206 R, 207 R, 237 R, 237 A

[56] References Cited

U.S. PATENT DOCUMENTS

| | | | |
|---|---|---|---|
| 1,460,841 | 7/1923 | Brody | 404/74 |
| 1,965,403 | 7/1934 | Alvey | 404/49 |
| 1,996,153 | 4/1935 | Heltzel | 404/87 |
| 2,230,303 | 2/1941 | Leguillon | 404/65 |
| 2,315,588 | 4/1943 | Brickman | 404/67 |
| 3,286,425 | 11/1966 | Brown | 52/396 |
| 3,368,464 | 2/1968 | Thorp, Jr. et al. | 404/74 |
| 3,523,493 | 8/1970 | Berry et al. | 404/47 |
| 3,923,411 | 12/1975 | Berghman | 404/64 |
| 4,030,852 | 6/1977 | Hein | 404/66 |
| 4,141,189 | 2/1979 | Borjeson | 404/64 X |
| 4,615,161 | 10/1986 | Milcham | 52/396 |
| 4,699,540 | 10/1987 | Gibbon et al. | 404/49 |

FOREIGN PATENT DOCUMENTS

| | | | |
|---|---|---|---|
| 564861 | 2/1958 | Belgium | 404/67 |
| 790888 | 7/1968 | Canada | 404/65 |
| 989657 | 5/1976 | Canada | 404/69 |
| 1087338 | 8/1960 | Fed. Rep. of Germany | 404/87 |
| 410034 | 10/1966 | Switzerland | 404/64 |

OTHER PUBLICATIONS

Jamak Fabrication Inc. brochure entitled Solasil Silicone Sealing Systems.

*Primary Examiner*—Ramon S. Britts
*Assistant Examiner*—Nancy P. Connolly

[57] ABSTRACT

Expansion joints are sealed with a combination of curable elastomeric adhesive and an elastomeric longitudinal sealing element having three segments in cross-sectional profile including parallel segments for bonding through the adhesive to the wall of the expansion joint, a looped or folded segment for completing the seal and compressive segments for positioning the longitudinal sealing element in the joint.

17 Claims, 2 Drawing Sheets

EXPANSION JOINT SEALS

The present invention relates to improved seals for expansion joints in buildings, roadways and other structures. More particularly, the present invention relates to improved seals for expansion joints having longer life and which utilize preformed elastomeric longitudinal sealing elements bonded into the expansion joint with curable elastomeric rubber.

BACKGROUND OF THE INVENTION

Expansion joints found, for example, in the external walls of high rise structures or between concrete slabs of a road surface are vital to allow the release of stress due to thermal expansion or contraction. Obviously, such a joint in buildings must be sealed to exclude weather, but in addition, it is vital that the joint be sealed to prevent the collection of foreign matter or debris therein. Accumulation of foreign matter or debris in an expansion joint will result in a loss of function in the joint due to an inability to close. This is clearly a danger with road joints or joints in other horizontal surfaces where foreign matter easily accumulates. It is also desirable to seal an expansion joint to prevent water from accumulating behind or beneath a surface with subsequent heaving when temperatures fall below freezing, and in the case of on grade concrete applications, to prevent the erosion of the supporting sub soil.

Expansion joint seals are commonly made either by pumping an asphalt or curable rubber compound into the joint or by inserting a sealing strip of rubber, plastic or other such material thereinto. It is no surprise, however, that these seals exposed to weather and possibly to the rigors of road traffic do not have the functional life of the concrete, stone or steel joints which they seal. Seals fail when adhesion to or contact with a face of the joint is lost by deterioration of the materials used in the seal or by excessive force applied. Various designs have been proposed to increase the functional life of the seal.

U.S. Pat. No. 4,615,151 teaches that metal anchors should be imbedded into wet concrete at the expansion joint rim that will upon setting be used to secure a flexible seal of the joint and prevent adhesive failure. U.S. Pat. No. 3,368,464 teaches that a flexible seal with premounted anchors should be imbedded into the concrete prior to setting. U.S. Pat. No. 3,286,425 teaches a flexible seal, which through compressive force against the opposing edges of the joint maintains its position in the joint. U.S. Pat. No. 2,315,588 shows another seal which utilizes simple compressive force. U.S. Pat. No. 3,923,411 shows a seal that uses a combination of compressive force with fluted members to prevent a seal from dislodging from the joint.

Each of the above mentioned seals have problems in connection with their use. Obviously, seals that must be inserted before concrete is set require that different methods of "forming" concrete be utilized. Such methods are not convenient and are not applicable to steel or granite, for instance. Seals that rely along on compressive force are easily inserted and replaced, but tend not to have a long functional life. The compression of these seals varies with expansion and contraction of the opposing joint faces adversely effecting the performance of the seal.

It is an object of the present invention to produce an expansion joint seal having a long functional life.

It is a further object of the present invention to produce such a seal that will remain firmly bonded and in contact with the faces of the expansion joint.

It is also an object of the invention to relieve the bonding faces of the seal of the tensile stress of contraction or compressive stress of expansion.

It is further object of the invention to produce a seal which is easily inserted and bonded into an expansion joint.

SUMMARY OF THE INVENTION

Briefly, there is provided by the present invention a longitudinal element of elastomeric material for sealing expansion joints having in cross-sectional profile; two parallel segments having two end areas each, having approximately parallel internally opposing faces and having approximately parallel external faces for bonding through an adhesive to opposed surfaces of said expansion joint, said external faces not for contact with said opposed surfaces; a looped or folded segment joining said parallel segments from an end area of one segment to the corresponding end area of the second segment to form a seal there between and to form the outwardly exposed top of the longitudinal sealing element whereby said looped or folded segment will flex with expansion or contraction of said expansion joint; and having two compressive contact segments, a surface of which extends in an approximately perpendicular direction from the external face of the remaining end area of each parallel segment to meet and run in contact with the corresponding opposed surface of the expansion joint and which are to be compressed into contact with the surface of said expansion joint through a compressive contact or joining with one another. There is also provided the sealed expansion joint and method to seal the same.

DETAILED DESCRIPTION OF THE INVENTION

Figure 1:
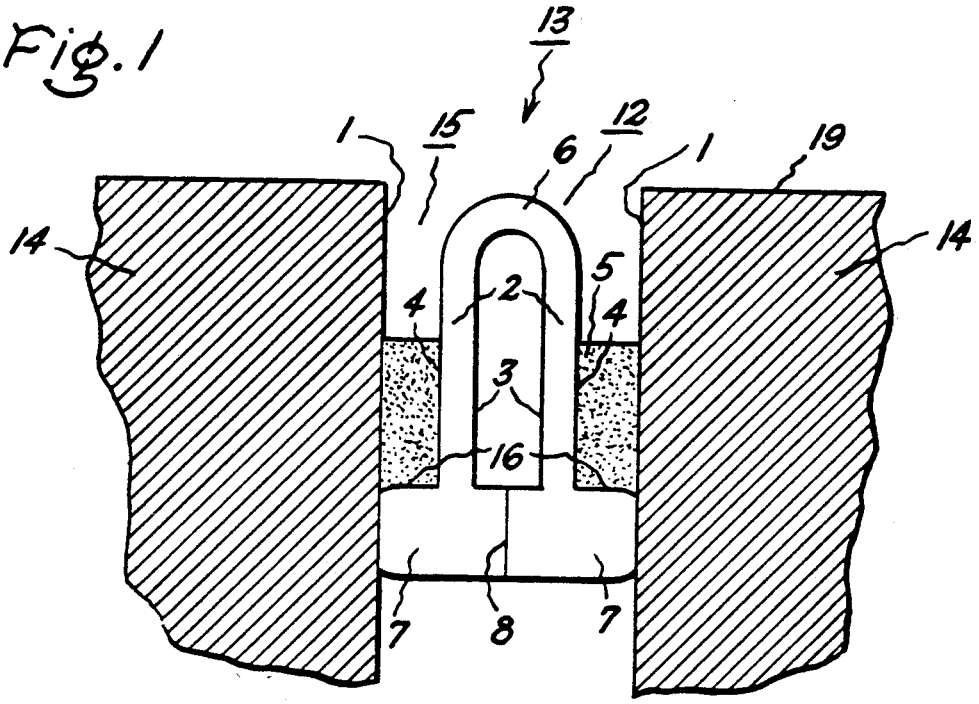
FIG. 1 is a side, cross-sectional view of a sealed expansion joint of the instant invention.
Figure 2:
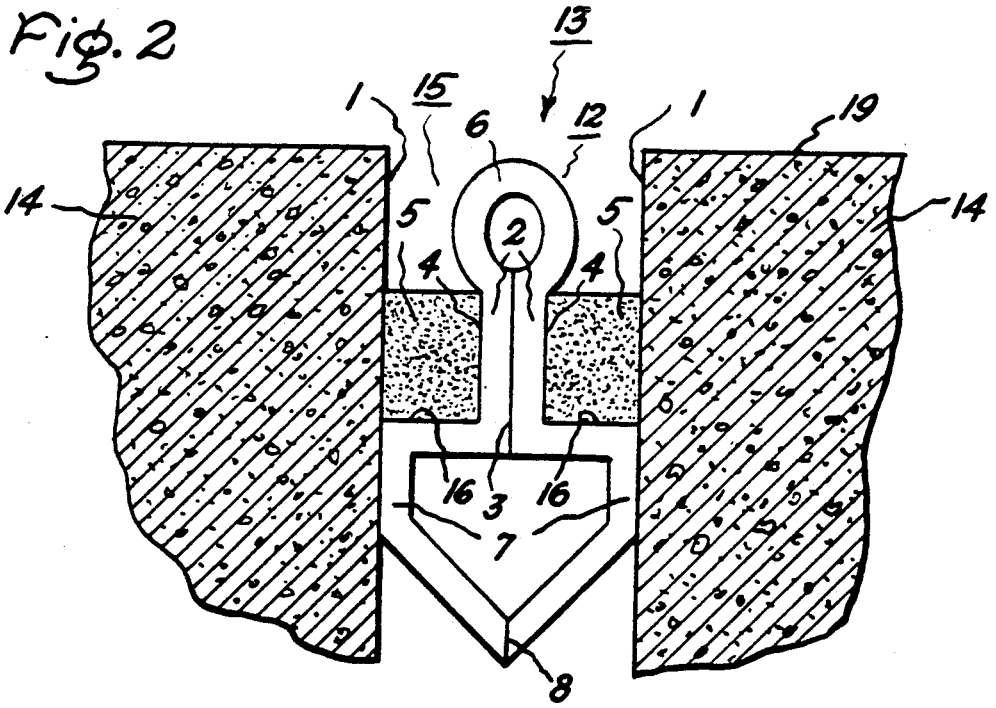
FIG. 2 is a side, cross-sectional view of a sealed expansion joint of the instant invention.
Figure 3:
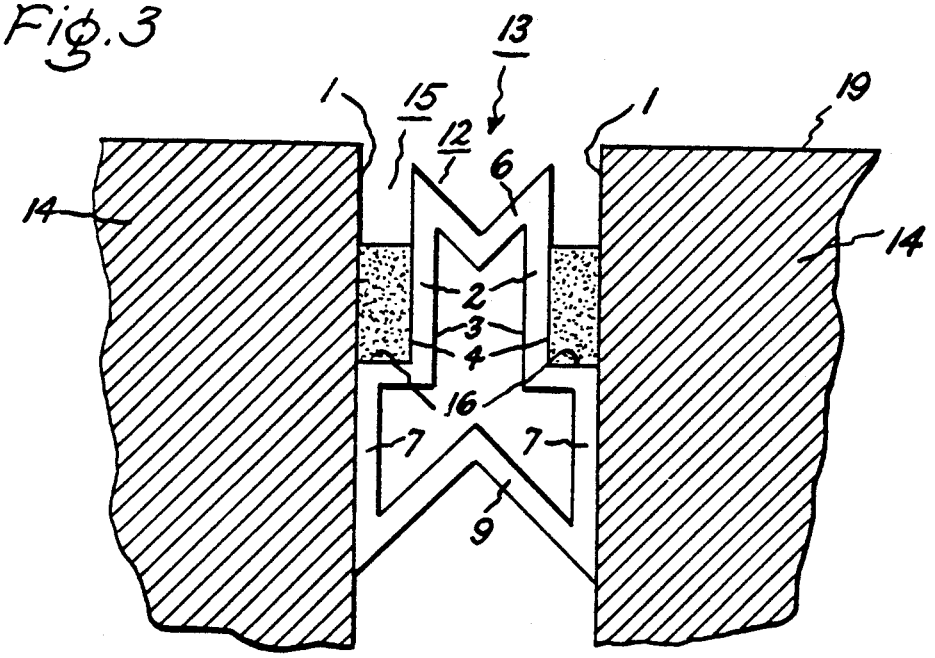
FIG. 3 is a side, cross-sectional view of a sealed expansion joint of the instant invention.

FIGS. 1–3 are a side, cross-sectional view of a sealed expansion joint designated generally as 13. The two adjacent structural sections 14 with outwardly facing surfaces 19 are spaced by slot 15 to allow for expansion or contraction of the structural sections. Slot 15 is formed where the planar edges of structural sections 14 are spaced to form parallel opposed surfaces 1. In expansion or contraction opposed surfaces 1 of structural elements 14 move closer or further away, one to another, respectively.

Structural sections 14 may be sections of a building, roadway, bridge, etc., and may be of concrete, granite, steel, plastic, aluminum or the like. The instant invention is most effective where there is a problem with accumulation of debris or high extension. Thus, the invention is most effectively employed where there is a large structural section in a horizontal plane such as in roadway.

The sealed expansion joint 13 includes a preformed longitudinal element 12 formed of an elastomeric material as further described below and installed to a predetermined depth in slot 15. The depth of installation should be such that the seal does not extend out of slot 15, and be unprotected by structural sections 14. Obviously the seal can be caught and torn or worn away where it is contacted by moving elements such as automobile tires, snow plows or even movable scaffolding on buildings.

Longitudinal element 12, in cross-section, has three essential segments. The parallel segments 2 are to bond the longitudinal element 12 securely into the slot 15. The looped or folded segment 6 is to flex with expansion or contraction of structural elements 14 while maintaining the seal. The compressive contact segments 7 are to aid in installation of the longitudinal element 12 and to subsequently stabilize this element in slot 15.

Parallel segments 2 are characterized by having approximately parallel internally opposing faces 3 and approximately parallel external faces 4, the external face not making direct contact with opposed surfaces 1 of structural elements 14. The function of parallel segments 2 is to provide a surface or portion of longitudinal element 12 whereby it may be bonded through an adhesive 5 to opposed surfaces of structural elements 14. As pictured, the adhesive is to fill the gap between external faces 4 and opposed surfaces 1 of structural element 14. Preferably parallel segments 2 are of approximately the same length. The length chosen for parallel segments 2 may vary with the situation but should be at a minimum such as to provide a sufficient surface for adhesive 5 under the circumstances. Generally for most expansion joints about ¼ inch to 2 inches of adhesive along the cross-sectional height of parallel segments 2 is sufficient for a secure bond. Thus the parallel segments 2 should have a height falling within this range.

Looped or folded segment 6 is characterized in that it joins the parallel segments from an end area of one segment to the corresponding end area of the second segment and forms the exposed top of the longitudinal sealing element 12. The looped or folded segment 6 forms a seal between the parallel segments that will flex with expansion or contraction of structural sections 14. It is essential that the looped or folded segment 6 not be bonded to the opposed surfaces 1 of structural elements 14 so as to permit the required flexibility.

The style of the looped or folded segment may vary as the name implies. The style may simply be that of an inverted "U" as shown in FIG. 1. In this case the cross-sectional height of the inverted "U" above the adhesive level should be greater than ½ the expected joint movement. The style may be that of the head of a split cotter pin as shown in FIG. 2. I this case the inside circumference of the looped segment should be sufficient to extend over the expected joint movement. The style may be that of a "V" or an inverted "V" as shown in FIG. 3. In this style multiple folds may be included to enable an accordian style flexing.

The object of the looped or folded segment 6 is clear to persons skilled in the art. Whether looped or folded or otherwise, designs which join the parallel segments 2 and provide a flexible seal are suitable.

The compressive contact segments 7 are characterized by having a perpendicular surface 16 that extends in an approximately perpendicular direction from the external face 4 of the remaining end area of each parallel segment 2 to meet and run in contact with the corresponding opposed surface 1 of the expansion joint 13. The perpendicular length of perpendicular surface 16 determines approximately the distance by which external faces 4 are separated from opposed surfaces 1. True to the name, it is a further and essential feature of compressive contact segments 7 that it be compressed into contact with opposed surfaces 1. Compression may be maintained by compressive contact between the compressive segments 7, for instance, at contacting surfaces 8 as shown in FIGS. 1 and 2, or by a compressive joining, for instance by joining segment 9 as shown in FIG. 3.

The function of compressive segments 7 is to aid in installation by holding elongated sealing element 12 in placed until cure of adhesive 5, to maintain uniform stress across the face of the adhesive bond by providing a fulcrum against structural sections 14, and to occupy space in the lower void of slot 15, thereby decreasing accumulation of debris and water. Ideally to achieve all of these goals at all time, compressive contact should be maintained, both at maximum contraction of structural sections 14 as well as at maximum expansion. Of course, it may happen that structural sections 14 may contact beyond the capability of compressive sections 7 to maintain compressive force and in FIGS. 1 and 2 the compressive sections may separate. In view of such, the compressive sections 7 should be designed so that contact is naturally restored upon expansion of structural sections 14. For example, the compressive segments 7 of FIG. 2 should be designed so that contact surface 8 will be restored upon expansion of structual sections 14.

Elastomeric materials for forming the longitudinal sealing elements are well known. Such materials include, for example, butyl rubber, ABS rubber, urethane rubber polysulfide rubber, neoprene rubber, rubberized asphalt, etc. However, considering high and low temperature properties, as well as resistance to ultraviolet light degradation and weathering, the preferred elastomeric material is a silicone rubber.

The design of the longitudinal sealing element 12 permits the use of silicone elastomeric material having a wide range of modulus. Herein the modulus of the elastomeric material might range from about 5 psi to 500 psi at 100% elongation. Further, it is not critical that the modulus of the elastomeric material be higher or lower than the modulus of the adhesive since the tensile stress of contraction is removed from the bonding face of the adhesive.

Preferred silicone rubber may be either a vinyl addition cure type or a peroxide cure type. Vinyl addition cure type rubbers are cured from a vinyl end-stopped diorganopolysiloxane gum, a hydride siloxane cross-linking agent, a filler, and platinum catalyst. The ingredients are simply mixed and will rapidly cure at room temperature. Inhibitors may be employed to delay cure. Peroxide cure type rubbers are cured from vinyl substituted diorganospolysiloxane gum, dimethyl gum, fumed silica optionally surface treated with a coupling agent, heat stabilizer and peroxide cross-linking agent. The ingredients are mixed and must be heated for rapid cure. Table 1 shows typical formulations for a peroxide cure rubber.

TABLE 1

| | A | B |
|---|---|---|
| (a) Methyl-vinyl, diorganopolysiloxane gum, 0.2 mole percent vinyl content | 11.7 | 53 |

TABLE 1-continued

| | A | B |
|---|---|---|
| (b) Dimethylpolysiloxane gum | 63.5 | 22 |
| (c) Structural control additives | 7.9 | 5.3 |
| (d) Fumed silica | 16.4 | 16.6 |
| (e) Heat stabilizer | 0.4 | 0.3 |
| (f) Reinforcing filler | — | 2.8 |

The longitudinal sealing element 12 is simply extruded in a continuous manner in the desired profile. Persons skilled in the art of such extrusion are practiced in both the necessary methods and the materials.

Adhesives useful herein may likewise be selected from a wide range of materials. Clearly a requirement of any adhesive is that it readily adhere to both the longitudinal sealing element 12 and the structural sections 14. Thus, the adhesive 5 may vary depending on whether the structural sections 14 are, for example, steel or concrete and whether the elongated sealing element 12 is butyl rubber or silicone. Adhesives suitable for use herein include adhesives such as urethane adhesives, butyl rubber adhesives, but again the preferred adhesive is a silicone adhesive due to the hostile environment of a road surface.

It is requirement herein that the adhesive 5, upon cure, have some elastomeric character to accommodate slight variations in the shape of longitudinal sealing element 12 and to prevent stress due to differing coefficients of thermal expansion at the interface with structural segment 14. It is the design of the longitudinal sealing element 12 that is intended to relieve the adhesive 5 of stress due to joint movement. Thus it is only necessary that the adhesive 5 have a functional modulus substantially greater than the functional modulus or effective modulus of the longitudinal sealing element 12 as opposed to the material of the sealing element.

The preferred silicone adhesives herein are more commonly known as silicone sealants of which there are a variety of types. The primary type of silicone sealant is the one component, moisture cured RTV sealant. The material cures where atmospheric moisture replaces hydrolyzable end groups can a silicone molecule, and the resultant hydroxy functions condense to build molecular weight. Various hydrolyzable end-groups are known, as well as catalysts, adhesion promoters, fillers, scavengers, etc. for use therein. One component, moisture cured RTV sealants, are found in U.S. Pat. Nos. 4,515,932; 4,395,526; 3,161,614; 4,417,042; and 4,145,359, hereby incorporated by reference. Another type of silicone sealant is the two component condensation cured sealant. This material is similar to the one component type material except that the presence of a quadrifunctional hydrolyzable group leads to rapid cross-linking on even residual moisture in the composition. The two component condensation cured sealant may be found in U.S. Pat. No. 3,888,815, hereby incorporated by reference.

The elongated sealing element 12 herein may be simply and securely installed. Sealing element 12 is inserted to a predetermined depth along substantially the entire length of slot 15, positioning compressive segments 7 inwardly and making compressive contact between compressive segments 7 and opposed surfaces 1 of structural sections 14. With compressive contact, element 12 will remain securely in place through application and cure of the adhesive 5. Subsequently there is applied an uncured adhesive between parallel segments 2 and opposed surfaces 1 to substantially fill the space therebetween from perpendicular surface 16 up to the end area of parallel segment 2 where looped or folded segment 6 begins. Thus the space formed between parallel segments 2 and opposed surfaces 1 acts as a metering guide for application of adhesive 5 that prevents waste. Otherwise the adhesive may work around an elongated sealing element having a different design and fill slot 15 below the sealing element with no beneficial effect. Of course, where an excessive amount of adhesive 5 is applied between parallel segments 2 and opposing surfaces 1, the adhesive will make contact with the looped or folded segment 6 and impede the flexing action thereof.

The space defined by parallel segments 2 and opposed surfaces 1 will determined the cross-sectional thickness of the adhesive. This thickness, i.e. the distance between external surfaces 4 and opposed surfaces 1, should range from about ⅛ inch to 1 inch depending on the application.

Subsequent to applying the adhesive it should be cured according to its chemistry. For the silicone sealants specifically taught above, this only requires allowing the adhesive to stand at room temperature for about 24 hours. Other adhesives may require heating. Of course, where heat is employed the materials must be able to withstand the method of heating such as brief exposure directly or indirectly to flame. It is possible that the UV curable adhesive might be employed in certain situations.

Figure 4:
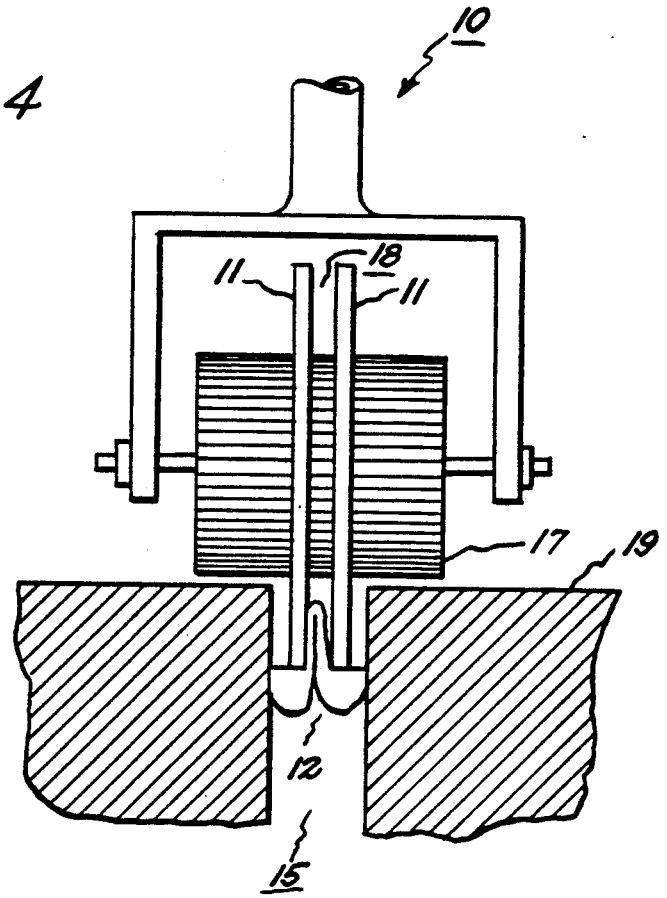
FIG. 4 is a side, partially cross-sectional view of a longitudinal sealing element being inserted into an expansion joint.

Advantageously, the longitudinal sealing element 12 might be inserted by means of inserting apparatus 10 shown in FIG. 4 having a rotatably mounted drum 17 from approximately the center of the external surface of which extend in a radial direction two discs of parallel planes having approximately equal radial height. The discs are spaced and have thickness to insert into slot 15. The spaced defined by discs 11 has an axial thickness sufficient to receive the looped or folded segment of seal element 12. Additionally, the radial height of disc 11 above the external surface of drum 17 is calculated to insert sealing element 12 at a desired depth into slot 15.

The continuous sealing element 12 is inserted into slot 15 by feeding the looped or folded segment and parallel segments thereof between the discs 11 of apparatus 10 while rolling the drum of apparatus 10 along the length of the expansion joint 13 with the discs 11 extending into slot 15 and drum 17 in contact with outwardly facing surfaces 19. By this manner the sealing element 12 may be easily and securely positioned.

Although the invention has been described by making detailed reference to preferred embodiments, such detail is to be understood in an instructive rather than in any restrictive sense. Many variations are possible within the scope of the claims hereunto appended.

What is claimed is:

1. A method for sealing an expansion joint formed where the edge of two structural sections having outwardly facing surfaces are spaced from one another to form an expansion slot with parallel opposed surfaces, each opposed surface extending to the outwardly facing surface of the structural segments, said method comprising the steps of:

(a) providing a sealing element having in cross-sectional profile: (i) two parallel segments having two end areas each, having approximately parallel internally opposing faces and having approximately parallel external faces for bonding through an adhesive to said opposed surfaces of said expansion joint, said external faces not in contact with said opposed surfaces, (ii) a looped or folded segment joining said parallel segments from an end area of a segment to the corresponding end area of the other segment, forming a seal therebetween and forming the outwardly exposed top of the sealing strip whereby said looped or folded segment will flex with expansion or contraction of said expansion joint and (iii) two compressive contact segments, a surface of which extends in an approximately perpendicular direction from the external face of the remaining end area of each parallel segment, meets and runs into contact with a corresponding opposed surface of the expansion joint and which are compressed into contact with the surface of an expansion joint through a compressive contact joining one with another, (b) inserting to a predetermined depth along substantially the entire length of said slot the longitudinal sealing element, by (i) feeding the looped or folded segment and parallel segments of said longitudinal sealing element between the discs of an inserting apparatus, said inserting apparatus comprising a rotatably mounted drum, from approximately the center of the external surface of which extend in a radial direction two discs of parallel planes having approximately equal radial height, the thickness and spacing of said discs proper so that the discs may be extended into said expansion slot and the looped or folded segment and parallel segments of said longitudinal sealing element may be inserted between said discs;

(ii) extending said discs into said expansion slot to the point where the external face of the rotatably mounted drum makes contact with the outward face of said structural sections, the discs having a radial height to extend into said expansion slot to properly position said longitudinal sealing element, and (iii) rolling said drum the length to said expansion slot whereby the seal is inserted;

(c) applying an uncured adhesive between said parallel segments and said opposed surfaces to substantially fill the space therebetween, said adhesive making no contact with the looped or folded section and being contained by said surface of said compression contact segment extending perpendicularly from said external face; and (d) curing said adhesive to thereby seal the joint.

2. The method of claim 1 wherein said parallel segments have a cross-sectional height of about ¼ to 2 inches.

3. The method of claim 1 wherein said parallel segments are of approximately the same length.

4. The method of claim 1 wherein said looped or folded segment is described as an inverted "U".

5. The method of claim 1 wherein said looped or folded segment is described as the head of a split cotter pin.

6. The method of claim 1 wherein said looped or folded segment is described as a "V" or inverted "V".

7. The method of claim 1 wherein said compressive contact segments are held in compression through compressive contact at a surface with one another.

8. The method of claim 1 wherein said compressive contact segments are held in compression by a compressive joining with one another.

9. The method of claim 1 wherein said sealing element is an elastomeric material selected from the group consisting of butyl rubber, ABS rubber, urethane rubber, polysulfide rubber, neoprene rubber, rubberized asphalt and silicone rubber.

10. The method of claim 9 wherein said elastomeric material has a modulus ranging from 5 to 500 psi at 100% elongation.

11. The method of claim 9 wherein said silicone rubber is vinyl addition cure rubber.

12. The method of claim 11 wherein said silicone rubber is a peroxide cure type rubber.

13. The method of claim 1 wherein the expansion joint is in a horizontally positioned surface.

14. The method of claim 1 wherein the expansion joint is in a roadway.

15. The method of claim 1 wherein said adhesive is an elastomeric adhesive selected from the group consisting of urethane adhesives, butyl rubber adhesives, silicone adhesives, ABS rubber, polysulfide rubber, neoprene rubber and rubberized asphalt.

16. The method of claim 15 wherein said adhesive is a one component, moisture curable, RTV silicone sealant.

17. The method of claim 15 wherein said adhesive is a two component, condensation curable silicone sealant.

* * * * *